US008157120B2

(12) United States Patent
Yang

(10) Patent No.: US 8,157,120 B2
(45) Date of Patent: Apr. 17, 2012

(54) CUP STRUCTURE

(75) Inventor: Ching-Mei Yang, Taichung (TW)

(73) Assignees: Jack Worth Co., Ltd., Taichung (TW); Ching-Mei Yang, Taichung (TW)

( * ) Notice: Subject to any disclaimer, the term of this patent is extended or adjusted under 35 U.S.C. 154(b) by 336 days.

(21) Appl. No.: 12/649,309

(22) Filed: Dec. 29, 2009

(65) Prior Publication Data

US 2011/0155747 A1 Jun. 30, 2011

(51) Int. Cl.
*B65D 25/10* (2006.01)
*B65D 1/40* (2006.01)
*A61J 1/00* (2006.01)

(52) U.S. Cl. ..... 220/678; 220/62.12; 220/377; 215/365; 215/377

(58) Field of Classification Search ..... 220/678, 220/662, 62.12, 376, 377, 592.16, 703, 737, 220/739, 918, 921, 62.14, 62.15; 215/365, 215/366, 374, 377, 12.1, 6; D7/619.1, 507, D7/509, 524, 523
See application file for complete search history.

(56) References Cited

U.S. PATENT DOCUMENTS

| | | | | |
|---|---|---|---|---|
| 3,499,238 | A * | 3/1970 | Publicker | 40/406 |
| 3,810,557 | A * | 5/1974 | Cline | 215/12.1 |
| 6,000,985 | A * | 12/1999 | Yeh | 446/129 |
| 6,334,271 | B1 * | 1/2002 | Su Yeh | 40/430 |
| D561,535 | S * | 2/2008 | Jin | D7/531 |
| D613,624 | S * | 4/2010 | Bodum | D10/46.2 |
| D618,510 | S * | 6/2010 | Ross | D7/523 |
| 2004/0144791 | A1 * | 7/2004 | Gluck | 220/703 |
| 2007/0056923 | A1 * | 3/2007 | Liu | 215/12.1 |
| 2008/0210694 | A1 * | 9/2008 | Castonguay | 220/592.17 |
| 2008/0264958 | A1 * | 10/2008 | Blake | 220/703 |

* cited by examiner

*Primary Examiner* — Bryon Gehman
*Assistant Examiner* — Shawn Braden

(57) ABSTRACT

An improved cup structure includes a cup body having an inner cup and an outer cup, with a space disposed between the inner cup and the outer cup. In the cup body, bottoms of the inner and outer cups are connected by an extension rod having an ornament; one end of the extension rod is adhered to an outer bottom of the inner cup and placed in the outer cup with the inner cup. Edges of the inner and outer cup are melted together, and glue is filled from an aperture at the bottom at the outer cup to secure the other end of the extension rod and the ornament within the space.

6 Claims, 6 Drawing Sheets

CUP STRUCTURE

BACKGROUND OF THE INVENTION

1. Field of the Invention

The present invention relates to an improved cup structure, and more particularly to an improved cup structure that provides visual effects.

2. Description of the Related Art

Currently, typical cup body structures, as shown in FIG. 6, have a cup body 20 that comprises an inner cup 21 and an outer cup 22, and the inner cup 21 and the outer cup 22 are gradually separated below their openings or necks and a space 23 is formed between the inner and outer cups 21, 22. When liquid is poured into the cup body 20, the double layered design provides good thermal isolation properties.

However, while the prior art structure can provide good thermal isolation properties, its appearance is not interesting or entertaining.

Therefore, it is desirable to provide an improved cup structure to mitigate and/or obviate the aforementioned problems.

SUMMARY OF THE INVENTION

An objective of the present invention is to provide an improved cup structure, which can be designed for different occasions or entertainment purposes.

A cup body has an inner cup and an outer cup, and a space is disposed between the inner cup and the outer cup. In the cup body, bottoms of the inner and outer cups are connected by an extension rod having an ornament, and one end of the extension rod is adhered to an outer bottom surface of the inner cup and placed in the outer cup together with the inner cup. Edges of the inner and outer cups are melted together, and glue (glass glue) is filled-in from an aperture at the bottom at the outer cup to secure the other end of the extension rod and the ornament within the space.

With the above-mentioned structure, the following benefits can be obtained: 1. The cup body has improved visual effects with the ornament for different occasions or purposes. 2. The ornament is placed between the inner and outer cups and is protected from damage by the outer cup.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
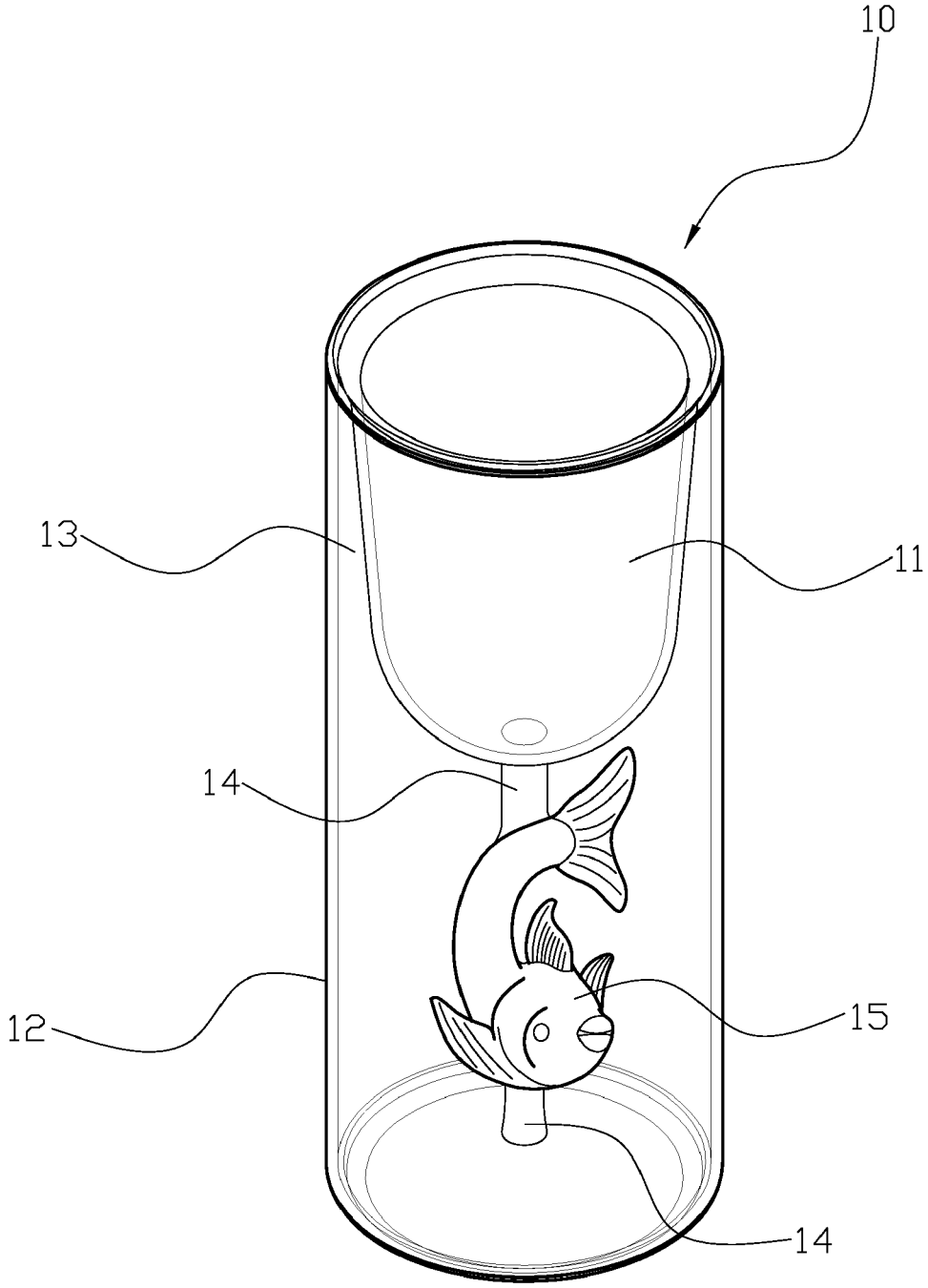
FIG. 1 is a perspective view of an embodiment of the present invention.
Figure 2:
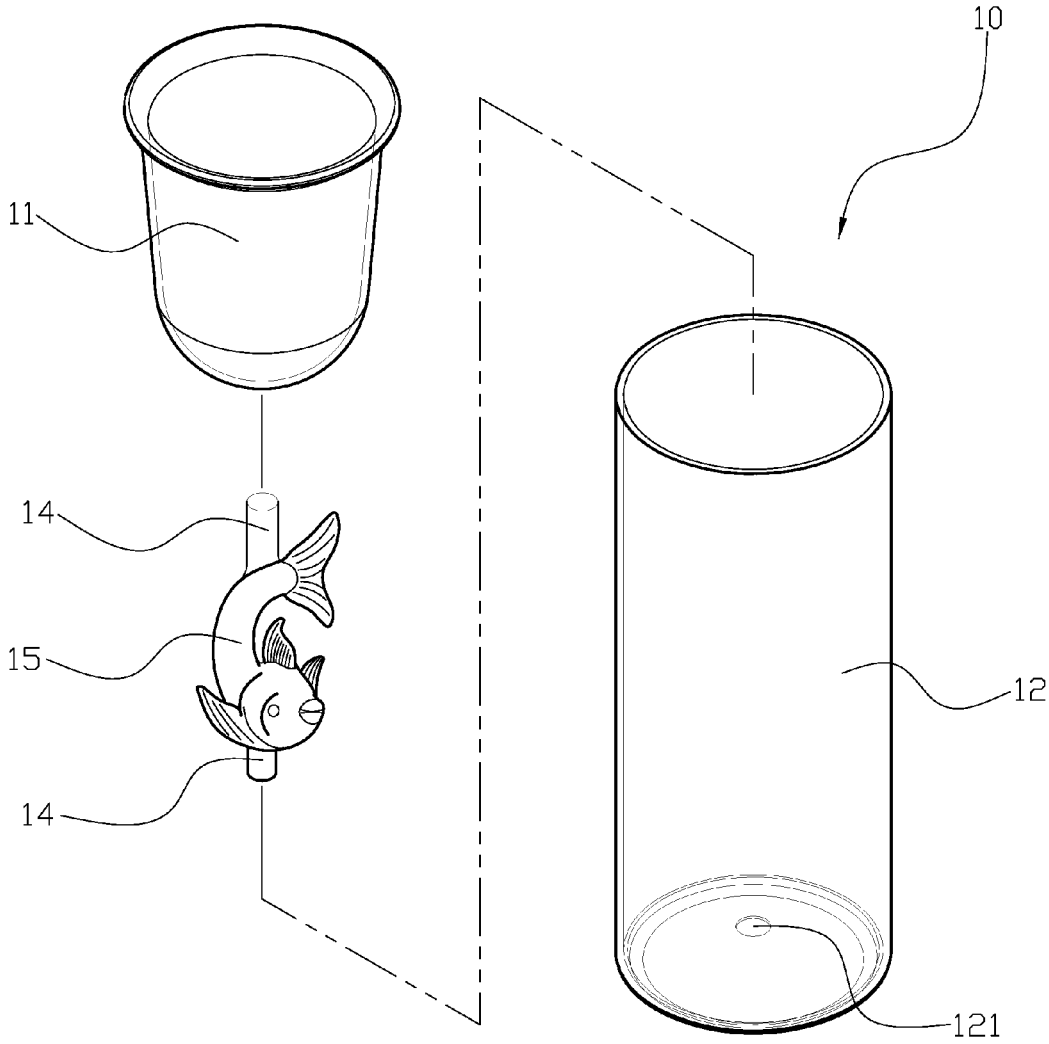
FIG. 2 is an exploded perspective view of an embodiment of the present invention.
Figure 3:
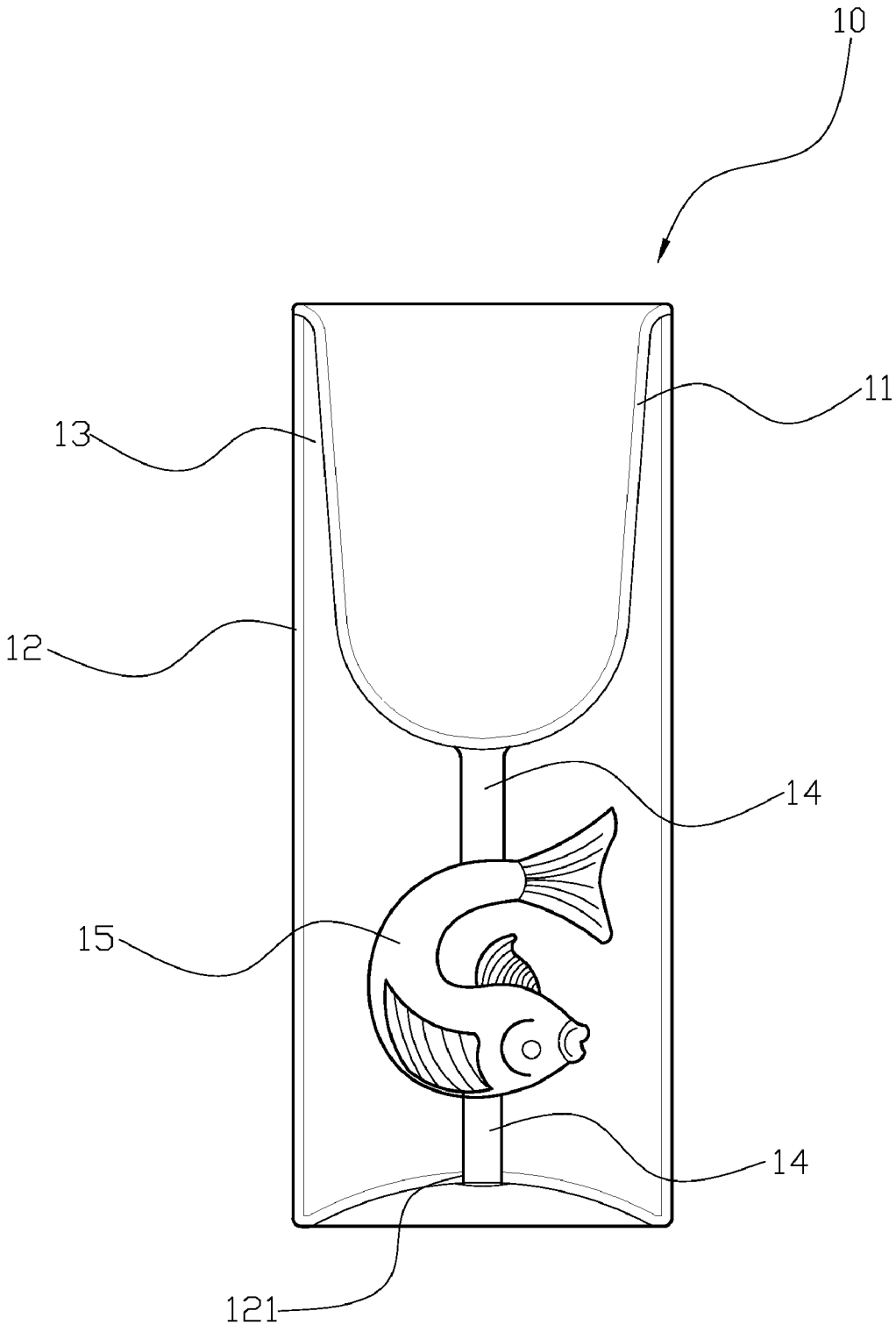
FIG. 3 is a schematic drawing of an embodiment of the present invention.
Figure 4:
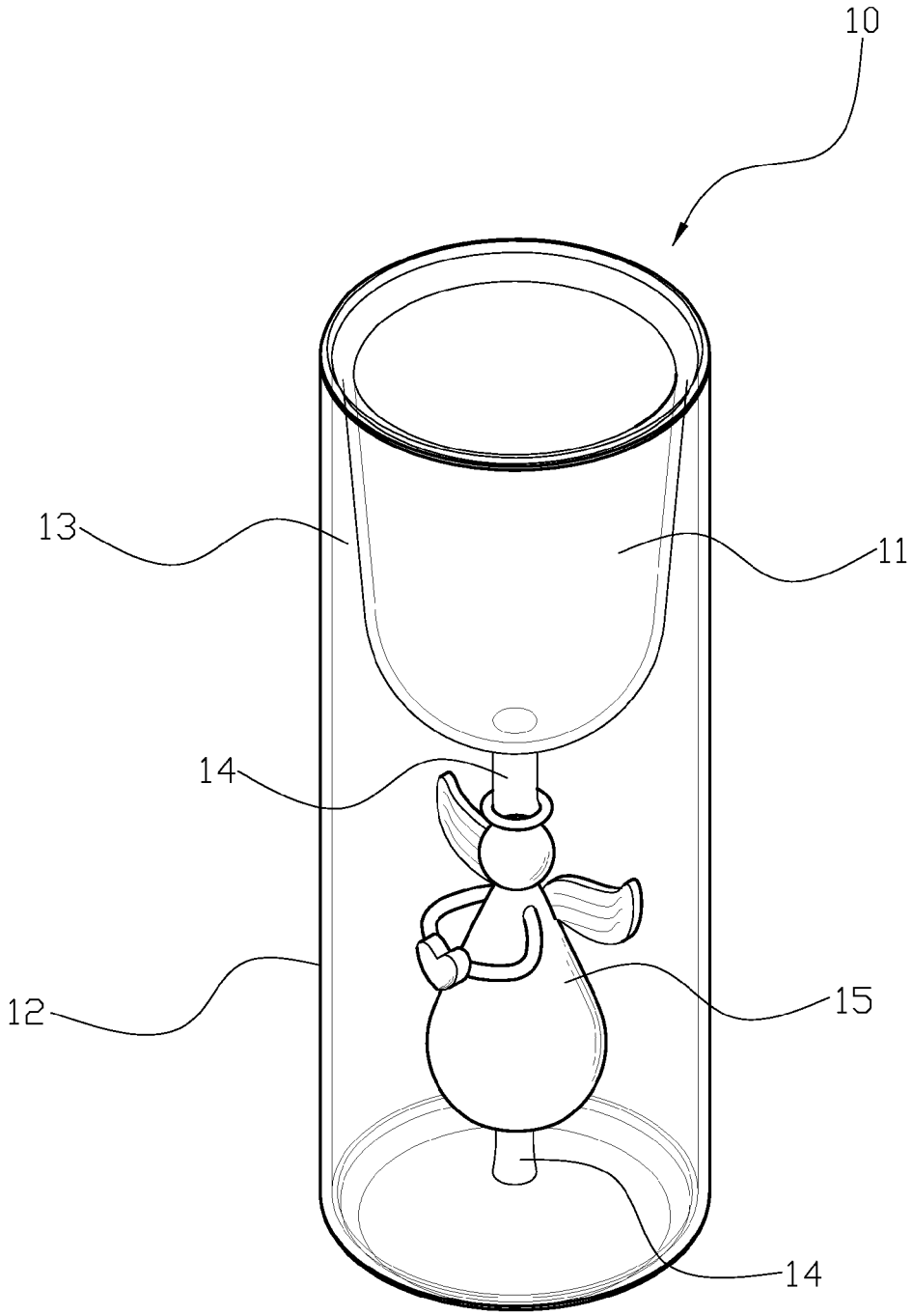
FIG. 4 shows an embodiment ornament according to the present invention.

First, please refer to FIGS. 1, 2 and 3. A cup body 10 has an inner cup 11 and an outer cup 12, and a space 13 is disposed between the inner cup 11 and the outer cup 12. In the cup body 10, bottoms of the inner and outer cups 11, 12 are connected by an extension rod 14 having an ornament 15, and one end of the extension rod 14 is adhered to an outer bottom surface of the inner cup 11 and placed in the outer cup 12 together with the inner cup 11. Edges of the inner and outer cups 11, 12 are melted together, and glue (glass glue) is filled-in from an aperture 121 at the bottom at the outer cup 12 to secure the other end of the extension rod 14 and the ornament 15 within the space 13.

Accordingly, for actual usage, liquid is poured into the inner cup 11, and the outer cup 12 is able to be held by a user. Since the inner and outer cups 11, 12 are separated by the space 13, if the liquid filling the inner cup 11 has a relatively higher or lower temperature, the space provides thermal isolation to prevent the user from being burned or suffering frostbite. Furthermore, this structure utilizes the ornament 15 to increase the visual effects of the cup body 10.

Figure 5:
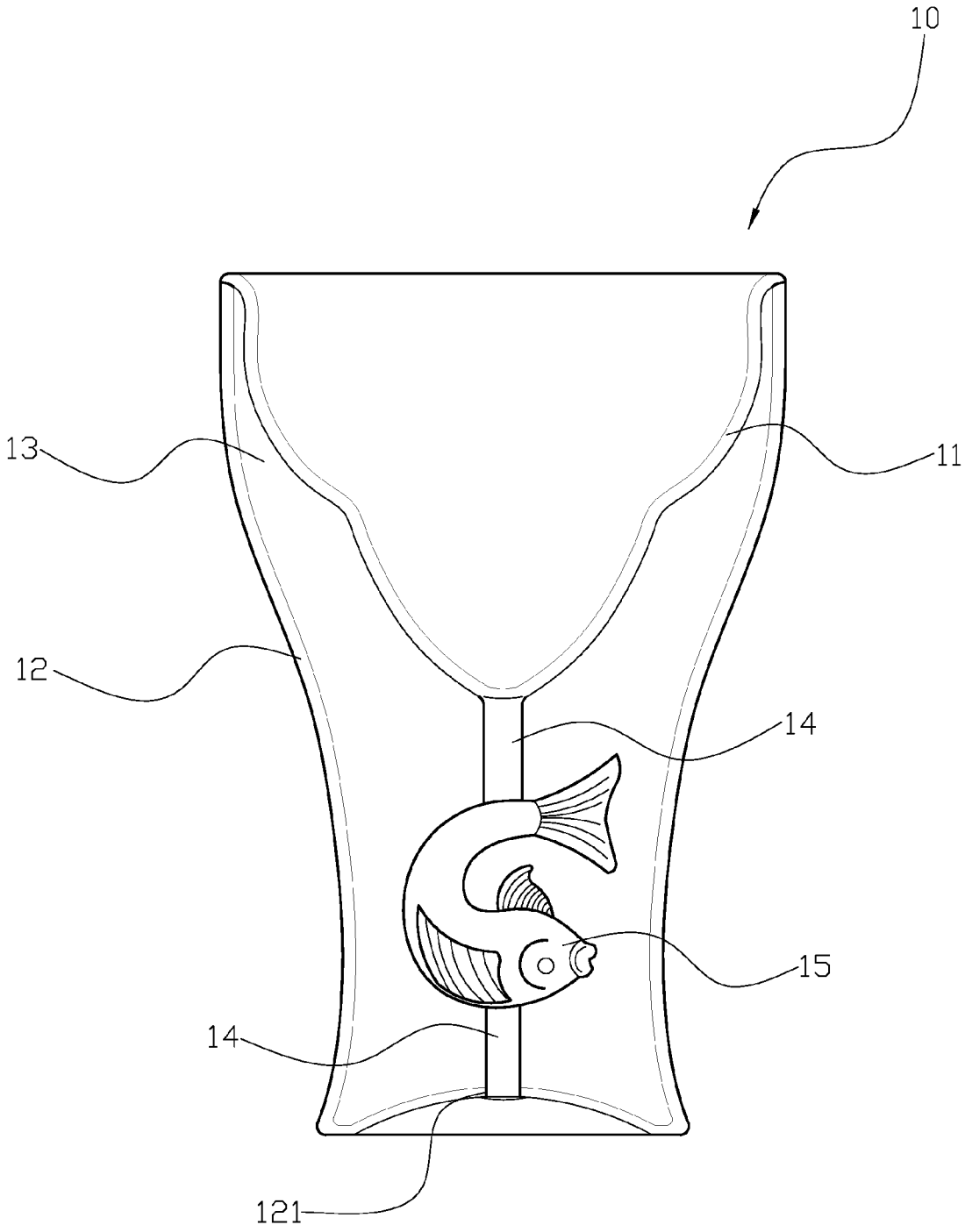
FIG. 5 shows an embodiment of inner and outer cups having curved profiles according to an embodiment of the present invention.
Figure 6:
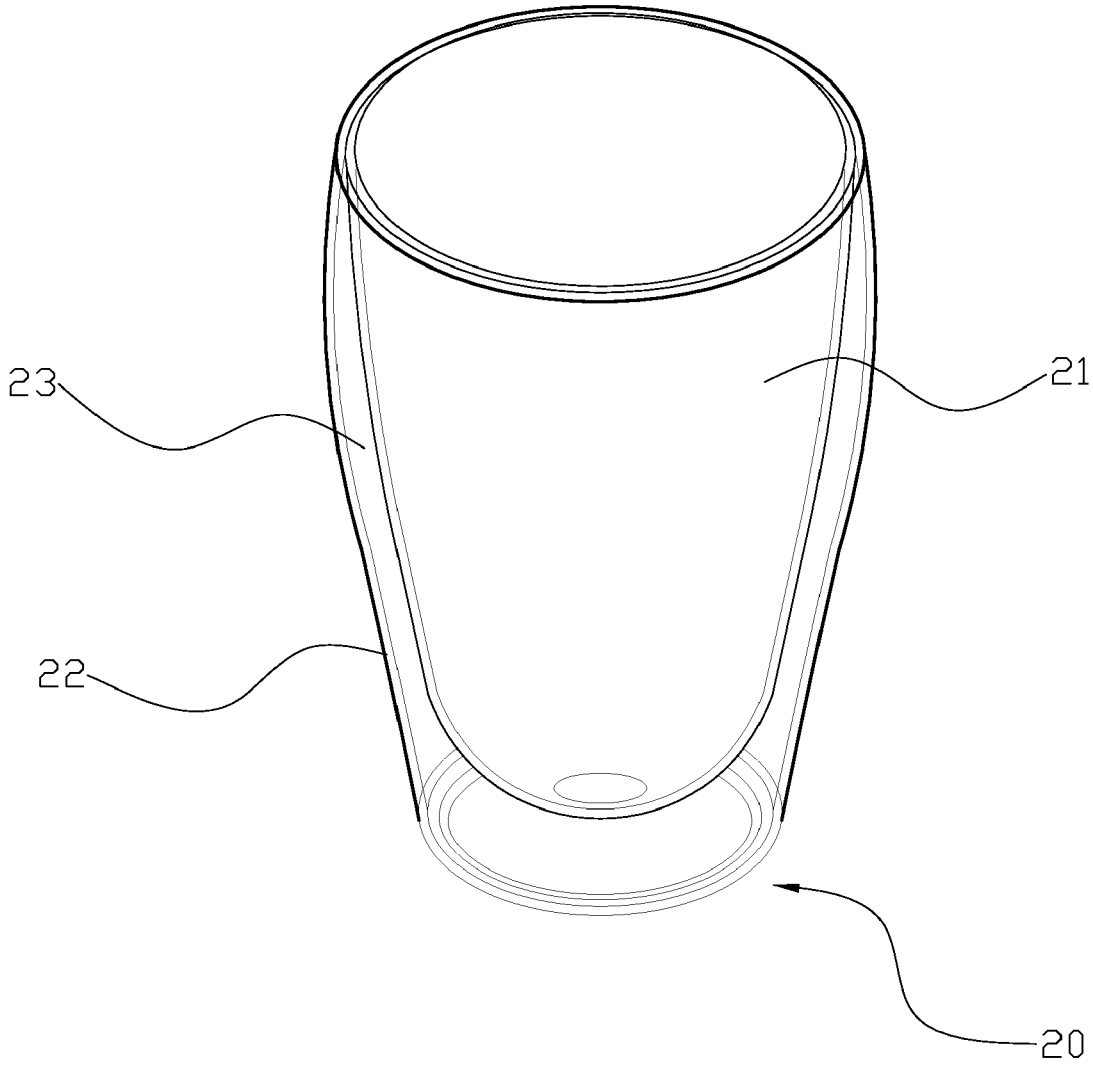
FIG. 6 PRIOR ART
FIG. 6 is a schematic drawing of a prior art cup body.

Moreover, the ornament 15 in the cup body 10 can be any one of various figures, such as animals, cartoon figures, lucky charms like angels, and have different colors, for more a impressive visual impact. In addition, the inner cup 11 and the outer cup 12 may have curved profiles as shown in FIG. 5, for different design appearances.

With the above-mentioned structure, the following benefits can be obtained: 1. The cup body 10 has improved visual effects with the ornament 15 for different occasions or purposes. 2. The ornament 15 is placed between the inner and outer cups 11, 12 and is protected from damage by the outer cup 12.

Although the present invention has been explained in relation to its preferred embodiment, it is to be understood that many other possible modifications and variations can be made without departing from the spirit and scope of the invention as hereinafter claimed.

What is claimed is:

1. An improved cup structure comprising a cup body having an inner cup and an outer cup, a space disposed between the inner cup and the outer cup, the cup structure characterized in that:

in the cup body, bottoms of the inner and outer cups are connected by an extension rod with two ends and having an ornament, one end of the extension rod adhered to an outer bottom of the inner cup and placed in the outer cup with the inner cup, edges of the inner and outer cups melted together, glue filling an aperture at the bottom at the outer cup to secure the other end of the extension rod and the ornament within the space.

2. The improved cup structure as claimed in claim 1, wherein the inner cup, the outer cup, the extension rod and the ornament of the cup body are all made of a glass material and combined together with a glass glue.

3. The improved cup structure as claimed in claim 1, wherein the inner cup and the outer cup are gradually separated from each other from below a cup opening or a cup neck to form the space between the inner and outer cups.

4. The improved cup structure as claimed in claim 1, wherein the ornament is a decorative object comprising fish, animals, or cartoon figures.

5. The improved cup structure as claimed in claim 1, wherein the ornament has different colors.

6. The improved cup structure as claimed in claim 1, wherein the inner cup and the outer cup have curved profiles.

* * * * *